United States Patent [19]

Araki

[11] Patent Number: 4,891,495

[45] Date of Patent: Jan. 2, 1990

[54] TEMPERATURE CONTROL DEVICE FOR HEAT-ROLL FUSING APPARATUS

[75] Inventor: Kazuhiro Araki, Toyokawa, Japan

[73] Assignee: Minolta Camera Kabushiki Kaisha, Osaka, Japan

[21] Appl. No.: 249,276

[22] Filed: Sep. 22, 1988

Related U.S. Application Data

[63] Continuation of Ser. No. 872,388, Jun. 10, 1986, abandoned.

[30] Foreign Application Priority Data

Jun. 14, 1985 [JP] Japan ..... 60-130642

[51] Int. Cl.[4] ..... G03G 15/00

[52] U.S. Cl. ..... 219/216; 219/471; 219/494; 355/285

[58] Field of Search ..... 355/3 FU, 14 FU, 282, 355/285, 286, 289; 219/216, 469, 470, 471, 494

[56] References Cited

U.S. PATENT DOCUMENTS

| | | | |
|---|---|---|---|
| 3,946,199 | 3/1976 | Nakamura | 219/216 X |
| 4,104,692 | 8/1978 | Sudo et al. | 219/216 X |
| 4,324,486 | 4/1982 | Nishikawa | 355/14 FU |
| 4,603,245 | 7/1986 | Yagosaki | 355/14 FU |
| 4,609,278 | 9/1986 | Taniguchi | 219/216 X |
| 4,627,714 | 12/1986 | Nozaki | 355/3 FU |
| 4,745,430 | 5/1988 | Tsuchiya | 355/3 FU |

FOREIGN PATENT DOCUMENTS

| | | |
|---|---|---|
| 59-8025 | 1/1984 | Japan . |
| 59-34577 | 2/1984 | Japan . |

*Primary Examiner*—A. D. Pellinen

*Attorney, Agent, or Firm*—Burns, Doane, Swecker & Mathis

[57] ABSTRACT

A temperature control device adapted to increase the roll surface temperature to the fusing temperature after initiation of power supply. When the roll surface temperature is to be increased from a level below a reference temperature, the current is supplied until the roll surface temperature reaches a predetermined temperature lower than the fusing temperature, and when the roll surface temperature is to be increased from a level higher than the reference temperature, the current is supplied for a predetermined time which is set according to the roll surface temperature at the initiation of power supply.

6 Claims, 6 Drawing Sheets

TEMPERATURE CONTROL DEVICE FOR HEAT-ROLL FUSING APPARATUS

This application is a continuation of application Ser. No. 872,388, filed June 10, 1986, which is now abandoned.

BACKGROUND OF THE INVENTION

The present invention relates to a temperature control device for the heat-roll fusing apparatus comprising a heat roll having a heater built therein and a pressure roll disposed in pressure contact with said heat roll. More particularly, the present invention relates to a device adapted to perform warming-up temperature control, that is to say the control of temperature from initiation of power supply till the surface temperature of said heat roll reaches a fusing temperature.

A variety of devices have been proposed heretofore in the art. For example, there is known a device such that in consideration of a temperature increase by overshooting, the heater is switched off at the time when a surface temperature sensor element has detected a preset temperature somewhat below the fusing temperature. Another known device is such that the heater current time is set in accordance with the detection value from a surface temperature element at the time when the power supply is switched on (Japanese Unexamined Patent Application No. 59-34577).

However, the former device in which temperature control is performed on the basis of a result of comparison with a predetermined temperature has the disadvantage that when the roll surface temperature at initiation of power supply is high, i.e. only slightly below the predetermined temperature, the heater current time is so short that the supply of thermal energy to the heat roll is small, with the result that the surface temperature of the heat roll does not rise to the required fusing temperature.

The latter device which performs temperature control according to current time, the thermal energy generated in a given time varies according to changes in source voltage so that when the source voltage is high, overshooting causes damage to the heat roll.

The above trouble occurs more frequently when the set time is longer, that is to say when the initial surface temperature is lower.

SUMMARY OF THE INVENTION

It is a primary object of the present invention to provide a temperature control device which is simple in construction and by which the roller surface temperature may be increased to a required fusing temperature with rapidly and positively.

It is another object of the present invention to provide a temperature control device by which the roller surface temperature can be increased to a required fusing temperature with rapidity and accuracy even on resumption of the supply of power after an interruption.

In accomplishing these and other objects, according to one preferred embodiment of these present invention, there is provided a temperature control device for a heat-roll fusing apparatus comprising a heat roll having a heating element built therein, a pressure roll in pressure contact with said heat roll and a sensing element for sensing a fusing temperature, said temperature control device comprising a first temperature control means for supplying a current to the heating element when an initial temperature is lower than a predetermined temperature, a second temperature control means for supplying the current to the heating element during the time determined based on the initial temperature, and selecting means for selecting either the first or the second temperature control mode at initiation of power supply, wherein said first temperature control mode is selected when the initial temperature is lower than a reference temperature, and said second temperature control mode is selected otherwise.

By the arrangement according to the present invention as briefly described above, an improved electrostatic latent image developing apparatus has been implemented in simple construction, with substantial elimination of the disadvantages inherent in the conventional developing apparatus of this kind.

BRIEF DESCRIPTION OF THE DRAWINGS

These and other objects and various features of the present invention will become apparent from the following description taken in conjunction with the preferred embodiment thereof with reference to the accompanying drawings, in which.

DETAILED DESCRIPTION OF THE INVENTION

One preferred embodiment of the present invention will now be described with reference to the accompanying drawings.

Figure 1:
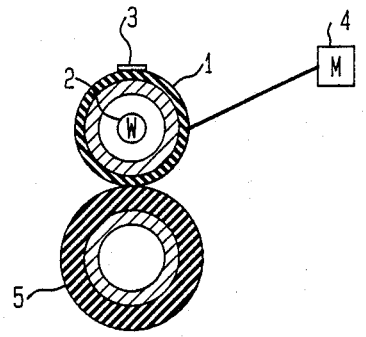
FIG. 1 is a schematic cross-section view showing the heat-roll fusing apparatus embodying the principle of the present invention.

Referring to FIG. 1 which shows the fusing apparatus of a copying machine not shown, a heat roll (1) driven by a motor (4) is equipped with a heater (2) built therein. A thermister (3) for detecting the surface temperature of said heat roll is also provided. The heat roll (1) is held in pressure contact with a pressure roll (5) in such a manner that the latter is driven in response to rotation of the heat roll (1). Thus, the toner on a copying paper travelling between these two rolls (1) and (5) is heated to fuse the toner on the copying paper.

Figure 2:
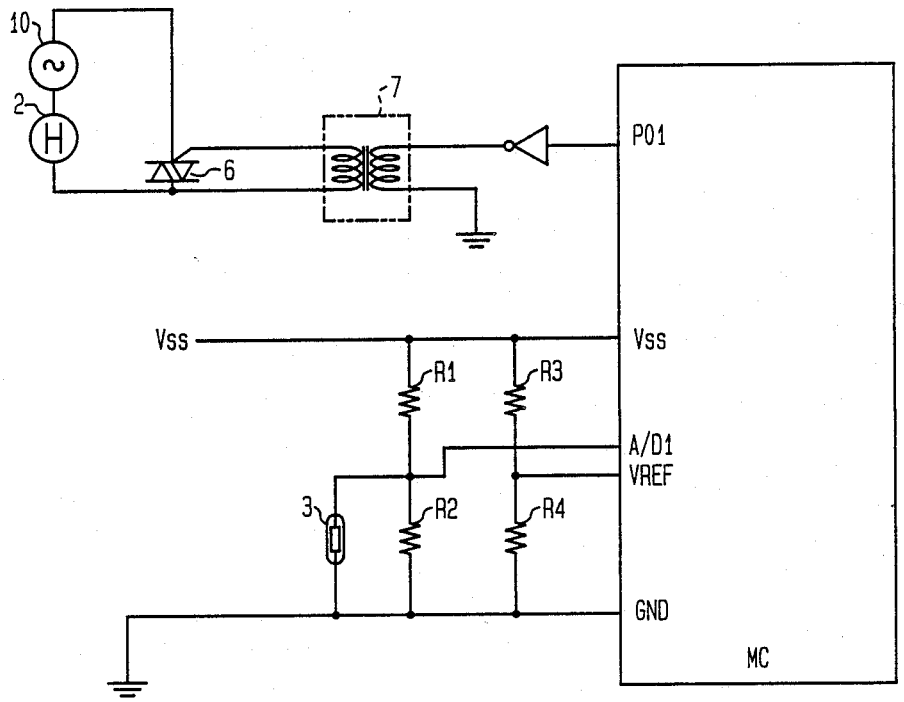
FIG. 2 is a circuit diagram for the temperature control device used in one embodiment of the present invention.

Referring to FIG. 2 which shows the control circuit used in the temperature control device of this embodiment, control is effected by a microcomputer (MC) equipped with an A/D converter.

The heater (2) is connected to an alternating current source (10) via a triac (6) which is triggered through a transformer (7) by a signal from an output port ($PO_1$). The thermister (3) is connected in parallel with a resistor ($R_2$) and in series with a resistor ($R_1$), and the potential is inputted to an input port ($A/D_1$) of the microcomputer (MC). The reference voltage for A/D conversion is inputted to an input port ($V_{REF}$) from resistors ($R_3$) and ($R_4$) connected in series.

The general principle of temperature control is explained below with reference to FIGS. 3 and 4. In the figures, ($T_S$) means a fusing temperature, ($T_{INT}$) is an initial temperature at start of current supply, and ($T_{MAX}$) is a maximum allowable temperature which is tolerated by the heat roll (1). In this embodiment, by comparing the initial temperature ($T_{INT}$) with the reference temperature ($T_0$) to be described hereinafter, the first temperature control mode based on the result of comparison with a predetermined temperature and the second temperature control mode based on the current time are switched from one to the other or vice versa.

Figure 3:
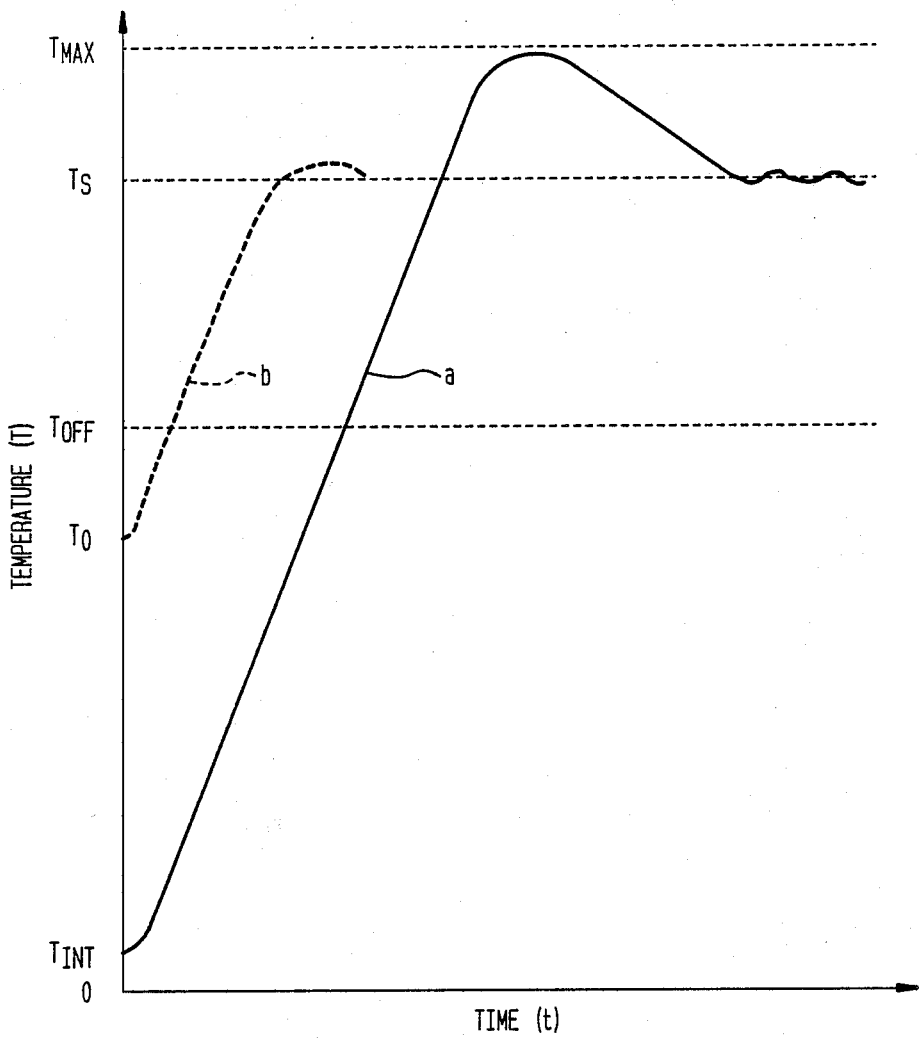
FIG. 3 is a graphic representation explaining the first temperature control mode in the embodiment of the present invention.

The first temperature control mode which is executed when the initial temperature ($T_{INT}$)is below the reference temperature ($T_0$) is shown in FIG. 3. Thus, an electric current is supplied to the heater (2) until the surface temperature of the heat roll (1) sensed by the thermister element (3) reaches a predetermined temperature ($T_{OFF}$). Here, said predetermined temperature ($T_{OFF}$) for turning off the heater (2) is set, as shown by the solid line in the figure, at a value such that when the initial temperature ($T_{INT}$) is sufficiently low and the source voltage for the heater (2) is high, the surface temperature after turning off the heater (2) will not rise to the maximum allowable temperature ($T_{MAX}$) by overshooting. And the reference temperature ($T_0$) is set at a value such that when the source voltage is low and the heater (2) is turned off at the temperature ($T_{OFF}$) set in the above manner, the surface temperature may increase to the fusing temperature ($T_S$) by overshooting as shown by the broken line in the figure. For reference, in the present embodiment, the fusing temperature ($T_S$) is set at 185° C., said predetermined temperature ($T_{OFF}$) at 140° C., and said reference temperature ($T_0$) at 120° C.

Figure 4:
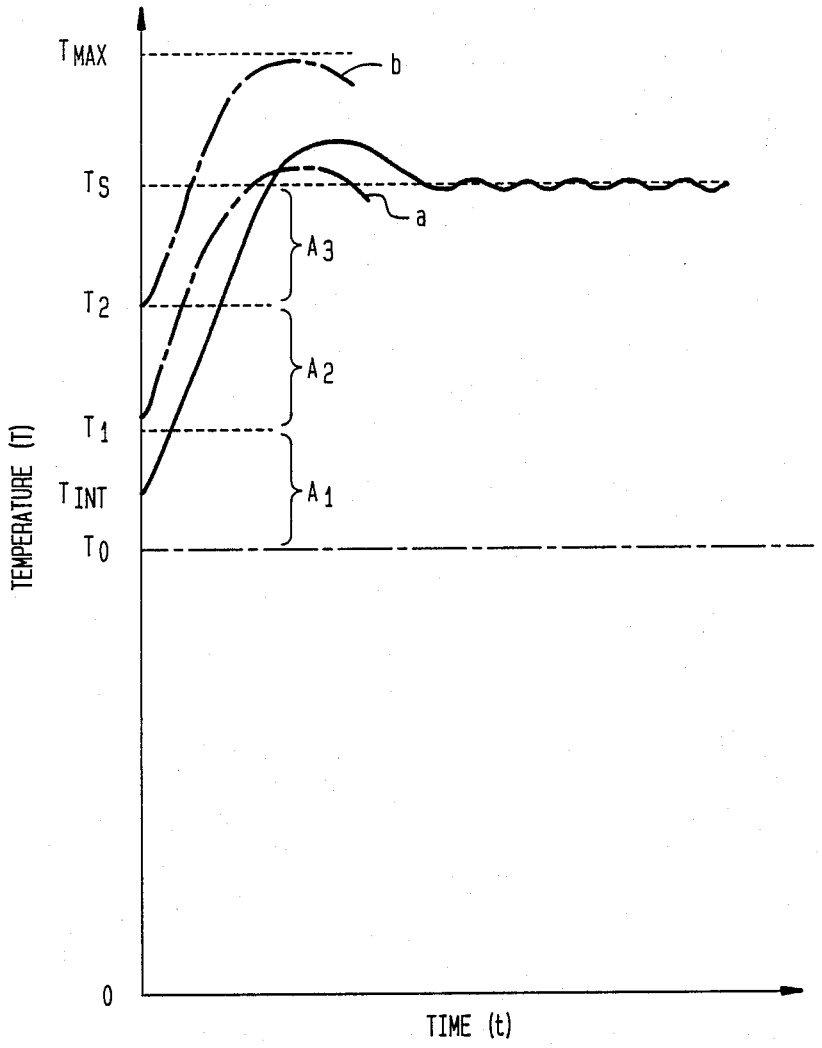
FIG. 4 graphic representation explaining the second temperature control mode in the embodiment of the present.

Then, the second temperature control mode which is executed when the initial temperature ($T_{INT}$) is higher than the reference temperature ($T_0$) is shown in FIG. 4. Thus, the temperature region from the reference temperature ($T_0$) to the fusing temperature ($T_S$) is divided into three areas and the heater current times corresponding to the respective areas ($A_1$), ($A_2$) and ($A_3$) are set at $t_1$, $t_2$, and $t_3$, respectively. The supply of current to the heater (2) is controlled by a timer according to the temperature area in which the initial temperature ($T_{INT}$) lies at initiation of power supply. In the figure, ($T_1$) and ($T_2$) are border temperatures of each area, and when the temperature region is divided in the above manner, at least the following conditions must be satisfied.

$$T_n - T_n - 1 < T_{MAX} - TS$$

$$(n = 1, 2, 3;\ T_3 = TS)$$

The heater current times $t_1$, $t_2$ and $t_3$ for the respective areas ($A_1$), ($A_2$) and ($A_3$) must be set so that even if the initial temperature ($T_{INT}$) is the lowest temperature of each area and the source voltage of current to be supplied to the heater (2) is low, the surface temperature will rise to the fusing temperature ($T_S$) by overshooting and that even when the initial temperature ($T_{INT}$) is the highest temperature of each area and the source voltage is high, the surface temperature will not rise beyond the maximum allowable temperature ($T_{MAX}$). Thus, taking Area ($A_2$) as an example, there holds the following approximate expression.

$$T_1+\eta^-\cdot T_2+T_{OVER} \geqq T_S \text{ [FIG. 4 (a)]}$$

$$T_2+\eta^+\cdot t_2+T_{OVER} < T_{MAX} \text{ [FIG. 4 (b)]}$$

$\eta^-$: the rate of temperature gain of the heat roll at a low source voltage.

$\eta^+$: the rate of temperature gain of the heat roll at a high source voltage $T_{OVER}$ : the temperature gain after heater OFF In the present embodiment, the border temperatures ($T_1$) and ($T_2$) are set at 140° C. and 160° C., respectively. It should be understood that while the temperature region is divided into three areas in this embodiment, it may be divided into a larger number of areas and that the beater current time may be computed from the initial temperature ($T_{INT}$).

Figure 5A:
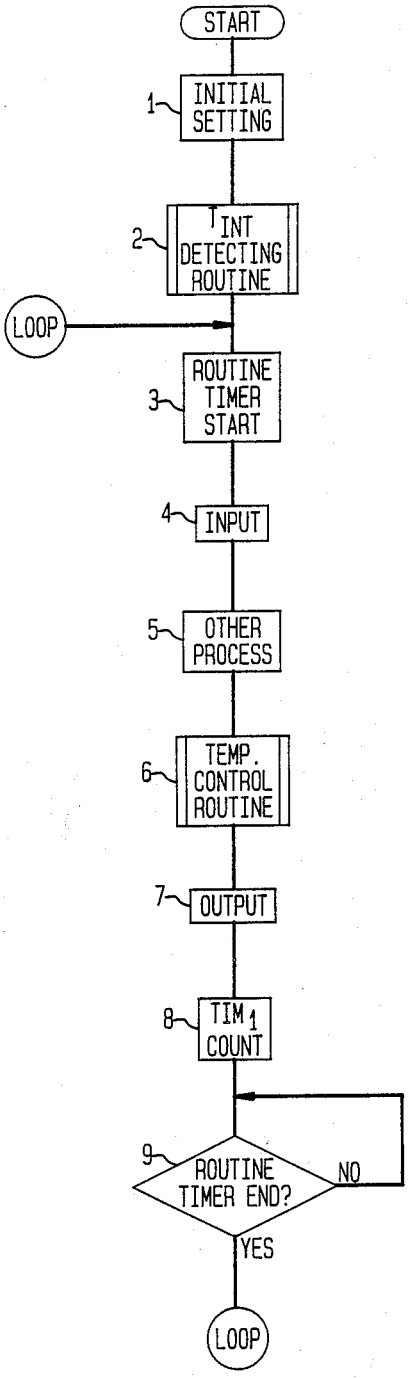
FIG. 5 (*a*), (*b*) and (*c*) are flow charts explaining the embodiment of the present invention.
Figure 5B:
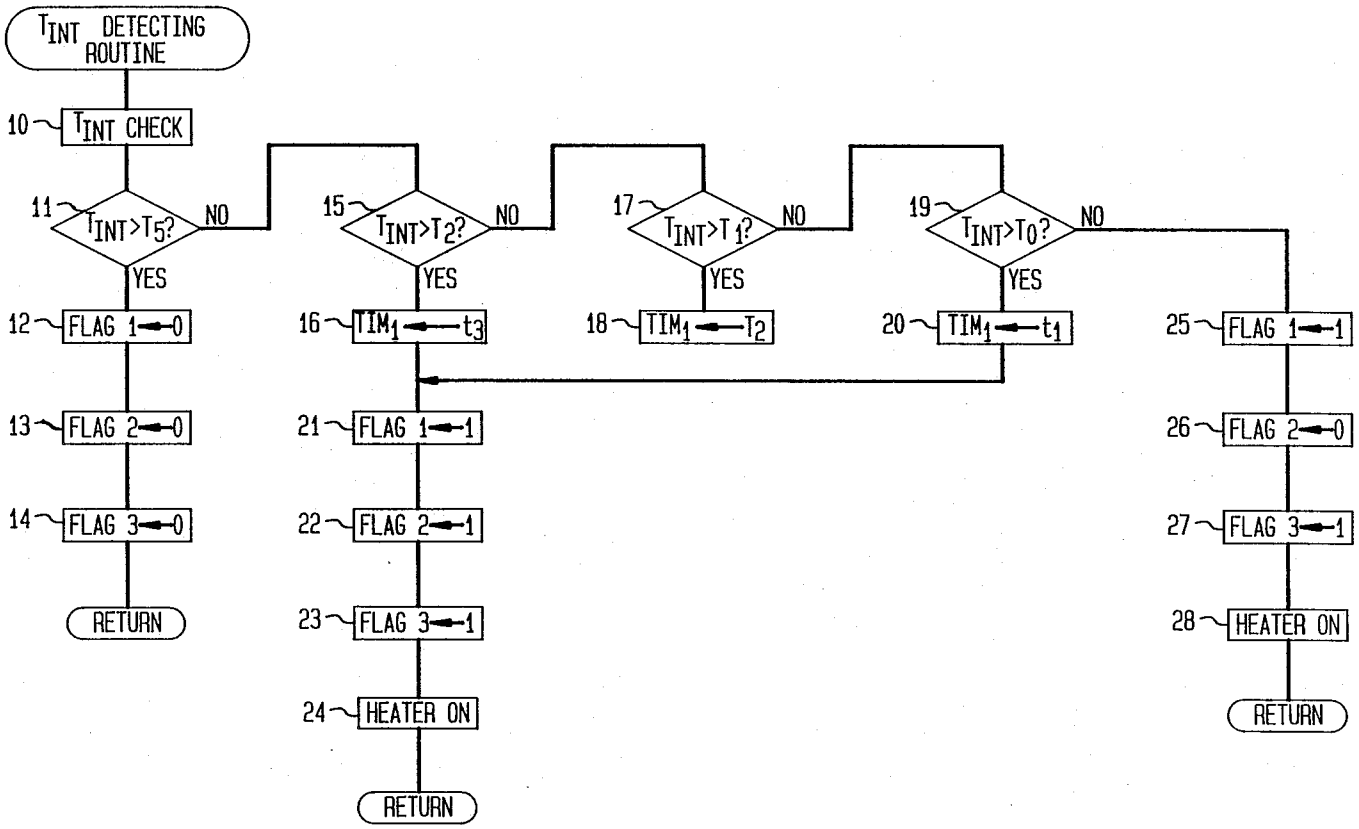
Figure 5C:
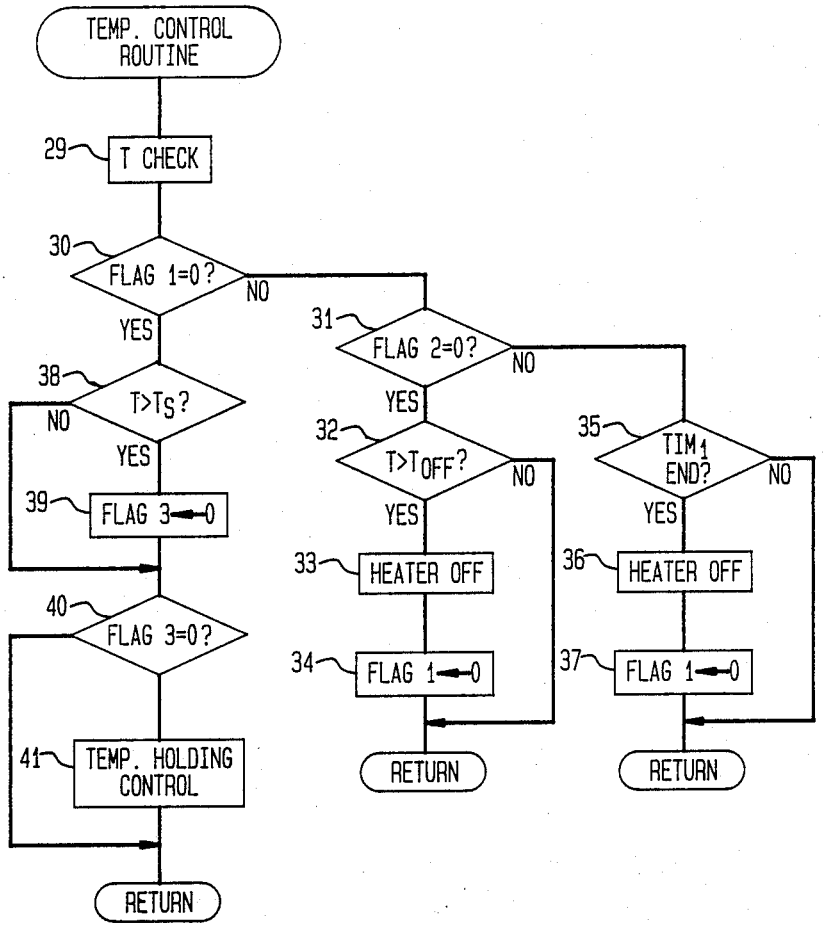

Now, the temperature control executed by the microcomputer (MC) will be explained in detail with reference to the flow charts shown in FIG. 5 (*a*), (*b*) and (*c*). It should be understood that these flow charts include only the components relevant to the present invention, with the other components omitted.

As the power supply to the copying machine is switched on, the initial setting of the microcomputer (MC) is performed in Step (1). Then, in Step (2) the initial temperature ($T_{INT}$) is detected according to the output from the thermister (3) and the setting of the control means and timer value is carried out. Details of this routine are shown in Steps (10) to (28).

In step (3) the routine timer for controlling a series of program execution times is started and in Step (4) the inputs from switches and sensors not shown are made. Then, in Step (5), the routine for the driving system and the trouble-shooting routine are carried out. Since these routines are not directly related to the present invention, they will not be further explained.

In Step (6), the temperature control routine is executed. Details of this routine are shown in Steps (29) to (41). After outputting is completed in Step (7), the timer ($TIM_1$) for setting the heater current time described later is counted in Step (8). Then, in Step (9), upon count-up of the routine timer, the routine returns to Step (3).

The operation for sensing the initial temperature in Step (2) is explained below.

First, in Step (10), the input from the thermister (3) is subjected to A/D conversion to detect the initial temperature ($T_{INT}$) of the surface of the heat roll (1). In Step (11), it is enquired if the initial temperature is higher than the fusing temperature ($T_S$).

If the judgement in Step (11) is YES, that is to say, if it is found that there is no need for warming-up, the warming-up flag (FLAG 1) indicating that warming-up is going on, the timer control flag (FLAG 2) indicating that the heating mode is the second temperature control based on current time, and the fusing temperature detection flag (FLAG 3) indicating that the surface temperature (T) remains yet to reach the fusing temperature ($T_S$) are reset in Steps (12), (13) and (14), respectively, to complete the initial temperature detection routine.

If it is judged in Step (11) that a warming-up operation is necessary, it is enquired in Steps (15), (17) and (19) if the initial temperature ($T_{INT}$) is within the range where the second temperature control mode is applicable.

To be more specific, it is first enquired in Step (15) if the initial temperature ($T_{INT}$) is higher than the border temperature ($T_2$). If the judgement is YES, the timer ($TIM_1$) is set to current time $t_3$, and if the judgement is NO, the routine proceeds to Step (17). In Step (17), it is enquired if the initial temperature ($T_{INT}$) is higher than the border temperature ($T_1$). If the answer is YES, the timer ($TIM_1$) is set to $t_2$ in Step (18). If the answer is NO, the routine advances to Step (19), where it is enquired if the initial temperature ($T_{INT}$) is higher than the reference temperature ($T_0$). If the answer is YES, the timer ($TIM_1$) is set to $t_1$ in Step (20). When the timer ($TIM_1$) is set to any of $t_1$, $t_2$ and $t_3$ in Step (15), (17) or (19), the warming-up flag (FLAG 1), timer control flag (FLAG 2) and fusing temperature detection flag (FLAG 3) are set in Step (21), (22) and (23), on to start the second temperature control mode which is based on current time.

On the other hand, if the enquiry in Step (19) generates a negative answer NO, the first temperature control mode based on the result of comparison with the predetermined temperature ($T_S$) is executed in the following manner. Thus, in Steps (25), (26) and (27), the warming-up flag (FLAG 1) and fusing temperature detection flag (FLAG 3) are set and the timer control flag (FLAG 2) is reset. Then, in Step (28), the heater (2) is turned on to start the first temperature control mode based on the above-mentioned comparison with ($T_S$).

Then, the temperature control function in Step (6) will be explained.

First, the input from the thermister (3) is subjected to A/D conversion in Step (29) and it is enquired in Step (30) if the warming-up flag (FLAG 1) has been reset. If the judgement in Step (30) is NO, it is regarded that the warming-up operation is going on and the routine proceeds to Step 31 where it is enquired if the timer control flag (FLAG 2) has been reset.

If the judgement in Step (31) is YES, that is to say if it is judged that the first temperature control mode is going on, it is enquired in Step (32) if the current roll surface temperature (T) is higher than the predetermined temperature ($T_{OFF}$). If the judgement in Step (32) is YES, the heater (2) is switched off in Step (33), the warming-up flag (FLAG 1) is reset in Step (34), and the routine proceeds to Step (7). If the judgement is NO, the routine proceeds directly to Step (7).

On the other hand, if the judgement in Step (31) is NO, that is to say it is judged that the second temperature control mode is going on, it is enquired in Step (35) if the timer ($TIM_1$) has counted up. If the enquiry in Step (35) generates an affirmative answer YES, the heater (2) is switched off in Step (36), the warming-up flag (FLAG 1) is reset in Step (37), and the routine proceeds to Step (7). If the judgement is NO, the routine proceeds directly to Step (7).

If the warming-up flag (FLAG 1) is reset in the above Step (12) or Step (34) or (37), the judgement in Step (30) is YES, that is to say it is judged in Step (30) that the warming-up operation has been completed and the routine proceeds to Step (38). In Step (38), it is enquired if the roll surface temperature (T) has reached the fusing temperature ($T_S$) by overshooting and if the judgement is YES, the fusing temperature detection flag (FLAG 3) is reset in Step (39). Then, through (30), the routine executes temperature control for maintaining the fusing temperature in Step (41). On the other hand, if it is judged in Step (38) that the roll surface temperature (T) has not reached the fusing temperature ($T_S$), the fusing temperature detection flag (FLAG 3) remains set and the judgement in Step (40) is NO, so that the temperature control for maintaining the fusing temperature is not started. The temperature control for maintaining the fusing temperature can be made by the conventional method, for example by ON-OFF control using the fusing temperature as a reference or by phase control, and will not be described in detail.

What is claimed is

1. A temperature control device for a heat roll fusing apparatus including a heat roll having a heating element therein, a pressure roll in contact with said heat roll and a sensing element for sensing a fusing temperature, said temperature control device comprising:

detecting means for detecting an initial temperature at initiation of power supplying; and temperature control means for supplying a current to the heating element so as to warm up the heat roll to a fixing temperature and operable in a first mode when the intial temperature is lower than a reference temperature and in a second mode when the initial temperature is higher than the reference temperature, wherein the current is supplied in the first mode until a time when the sensing element senses a predetermined temperature which is lower than the fixing temperature, whereas the current is supplied in the second mode during a predetermined time.

2. A temperature control device for a heat roll fusing apparatus as claimed in claim 1 wherein said predetermined time corresponds to a temperature range between the reference temperature and the fixing temperature.

3. A temperature control device for a heat roll fusing apparatus as claimed in claim 1, wherein said predetermined time is determined by calculation based on the initial temperature.

4. A temperature control device for a heat roll fusing apparatus as claimed in claim 1, wherein said reference temperature is lower than the fixing temperature.

5. A temperature control device for a heat roll fusing apparatus including a heat roll having a heating element therein, a pressure roll in contact with said heat roll, a sensing element for sensing a fusing temperature and a temperature maintaining means for maintaining said fusing temperature at a fixing temperature, said temperature control device comprising:

temperature control means for supplying a current to the heating element so as to warm up the heat roll to a fixing temperature and operable in a first mode when the initial temperature is lower than a reference temperature and in a second mode when the initial temperature is higher than the reference temperature, wherein the current is supplied in the first mode until a time when the sensing element senses a predetermined temperature which is lower than the fixing temperature, whereas the current is supplied in the second mode during a predetermined time; and prohibiting means for prohibiting operation of the temperature maintaining means when the heat is at a lower temperature than the fixing temperature.

6. A temperature control device for a heat roll fusing apparatus as claimed in claim 5, wherein said reference temperature is lower that the fixing temperature.

* * * * *